US006152773A

United States Patent [19]

Chen

[11] Patent Number: 6,152,773

[45] Date of Patent: Nov. 28, 2000

[54] ELECTRICAL CONNECTOR HAVING RELIABLY SECURED SHIELD

[75] Inventor: Cho-Hsu Chen, Chia-I, Taiwan

[73] Assignee: Hon Hai Precision Ind. Co., Ltd., Taipei, Taiwan

[21] Appl. No.: 09/329,095

[22] Filed: Jun. 9, 1999

[30] Foreign Application Priority Data

Dec. 24, 1998 [TW] Taiwan ..... 87221554

[51] Int. Cl.[7] ..... H01R 13/648

[52] U.S. Cl. ..... 439/607

[58] Field of Search ..... 439/607, 378

[56] References Cited

U.S. PATENT DOCUMENTS

| | | | |
|---|---|---|---|
| 5,037,330 | 8/1991 | Fulponi et al. | 439/607 |
| 5,125,853 | 6/1992 | Hashiguchi | 439/607 |
| 5,591,050 | 1/1997 | Sueoka | 439/607 |
| 5,725,386 | 3/1998 | Davis et al. | 439/607 |

*Primary Examiner*—Neil Abrams
*Assistant Examiner*—Javaid Nasri
*Attorney, Agent, or Firm*—Wei Te Chung

[57] ABSTRACT

An electrical connector comprises a number of contacts, a first dielectric housing, a second dielectric housing having a pair of support portions, a shield forming a number of latching openings therein and a pair of clasps thereon, and a pair of guiding members. The first and second housings are fixed together and the contacts are received therein. A number of latching members are formed on opposite side walls of the first housing for engaging with corresponding latching openings of the shield. Each latching member comprises a neck and a head. A recess is defined in a cavity formed in each support portion of the second housing for engaging with corresponding clasps. A V-shaped guiding cutout communicates with each latching opening and has a configuration flaring from the latching opening. The cutout has a width smaller than the diameter of the corresponding head. Thus, the shield can be easily and securely engaged with the first housing by fitting the necks into the corresponding latching openings through the corresponding guiding cutouts.

9 Claims, 3 Drawing Sheets

ELECTRICAL CONNECTOR HAVING RELIABLY SECURED SHIELD

BACKGROUND OF THE INVENTION

The present invention relates to an electrical connector, and especially to an electrical connector having a shell securely fixed to a dielectric housing of the connector.

Connectors are widely applied in electronic instruments for signal transmission between inner components of the electronic instrument or between the electronic instrument and other electronic systems. An electrical connector commonly consists of a dielectric housing and a plurality of conductive contacts. A shield is often fixed to the housing for shielding the electrical connector from exterior electromagnetic interference. A conventional shield is stamped and formed from a metal sheet and usually forms retention means for latching the shield to a housing of the connector. A pertinent conventional connector is disclosed in Taiwan Patent Application No. 84207642.

A conventional retention means may comprise latching openings defined in opposite side walls of a shield and projections formed on opposite side walls of a dielectric housing of a connector. When the shield is fixed to the housing, the latching openings engage with the corresponding projections of the housing. However, the opposite side walls of the shield must be deformed away from each other for facilitating engagement with the corresponding projections. The shield may not completely recover from such a deformation thereby adversely affecting the stability and reliability of the engagement between the shield and the housing. Furthermore, the shield may be frequently subject to a force for connecting/separating the connector with/from a mating connector. However, the conventional retention means cannot effectively resist such a force.

Therefore, a new retention means is required for an electrical connector which can ensure a reliable engagement between a shield and a housing of the connector and effectively resist a force for connecting/separating the connector with/from a mating connector.

BRIEF SUMMARY OF THE INVENTION

A main object of the present invention is to provide an electrical connector comprising a shield be quickly and securely fixed to a dielectric housing.

Another object of the present invention is to provide an electrical connector comprising a dielectric housing and a shield wherein an engagement between the housing and shield can effectively resist a force for connecting/separating the connector with a mating connector.

Another object of the present invention is to provide an electrical connector comprising guiding members and a shield, wherein a grounding path is established between a shell of a mating connector, the guiding members, the shield and a circuit board for discharging static electricity accumulated on the mating connector before contacts of the connector are electrically engaged with contacts of the mating connector.

In accordance with one aspect of the present invention, an electrical connector comprises a dielectric housing, a plurality of contacts received in the housing, a shield enclosing the housing and guiding members. The shield is attached to the housing by means of a plurality of latching openings formed in the shield, cutouts defined in the shield in communication with the corresponding latching opening, clasps integrally formed on bottom edges of opposite end walls of the shield, and a plurality of latching members formed proximate bottom edges of opposite side walls of the housing corresponding to the latching openings of the shield. Each latching members of the housing comprises a neck and a head. When the shield is fixed to the housing, the neck engages with the corresponding latching opening through the cutout, while the head prevents the shield from moving in a direction vertical to a mating direction of the connector. Thus, the shield will not become disengaged from the housing due to the dimension of the head being larger than the latching opening. The clasps are fixed to the housing by the guiding members and cooperate therewith for preventing the shield from moving in a direction parallel to the mating direction of the shield by a force connecting/separating the connector with/from the mating connector. When the connector which has been soldered to a circuit board is going to mate with a mating connector, before contacts of the two connectors engaging with each other, a grounding is established by a shield of the mating connector, the guiding members, the shield, and the circuit board to discharge static electricity from the mating connector to the circuit board.

Other objects, advantages and novel features of the invention will become more apparent from the following detailed description when taken in conjunction with the accompanying drawings.

DETAILED DESCRIPTION OF THE INVENTION

Figure 1:
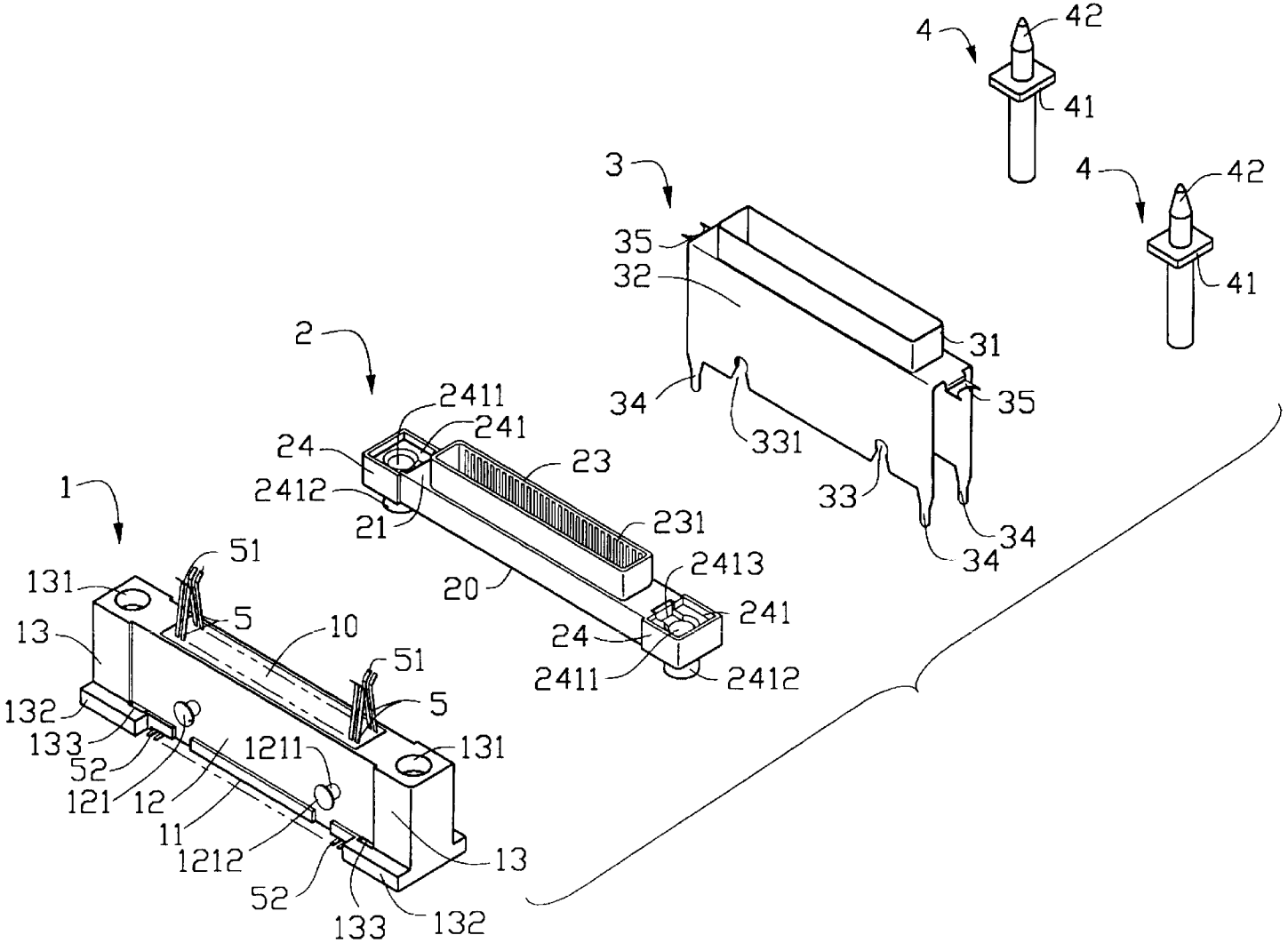
FIG. 1 is an exploded view of an electrical connector in accordance with the present invention.

Referring to FIG. 1, an electrical connector in accordance with the present invention comprises a housing assembly including a first elongate dielectric housing 1 forming a mating surface 10 and a joining surface 11, a second elongate dielectric housing 2, a shield 3, a pair of guiding members 4 and a plurality of contacts 5 received in the first housing 1. Each contact 5 comprises a mating end 51 extending from the mating surface 10 of the first housing 1 for connecting with a mating connector (not shown) and a joining end 52 extending from the joining surface 11 for electrically connecting with a circuit board (not shown).

In order to ensure proper positioning of the contacts 5 within the first housing 1, the first housing 1 is insert molded twice. The first housing 1 is partially insert molded to position the contacts 5, and is then wholly insert molded to integrally form the first housing 1 and the contacts 5.

The first housing 1 forms a pair of opposite side walls 12 parallel to each other and extending from the mating surface 10 to the joining surface 11. Two latching members 121 project from each side wall 12 proximate the joining surface 11. Each latching member 121 comprises a neck 1211 extending from the corresponding side wall 12 and a head 1212 joining the neck 1211. The neck 1211 has a smaller diameter than the head 1212, and has a length substantially identical to the thickness of the shield 3 thereby preventing the shield 3 from movements perpendicular to the mating direction.

The first housing 1 also forms a pair of bases 13 at opposite ends thereof. Each base 13 defines a guiding hole 131 in the mating surface 10 toward the joining surface 11.

A pair of extensions 132 project from opposite sides of each base 13 and each have a bottom face (not shown) being flush with the joining surface 11. A pair of insertion slots 133 are defined through each extension 132 proximate the corresponding side wall 12.

The second housing 2 is elongate, corresponding to the first housing 1, and comprises a joining face 20, a mating face 21 and a mating section 23 upwardly projecting from the mating face 21. A plurality of engaging slots 231 are defined in opposite inner side walls of the mating section 23 and exposed to the joining face 20 for receiving the mating ends 51 of the contacts 5 therein. The second housing 2 forms a pair of support portions 24 between the mating face 21 and the joining face 20 at opposite ends thereof. Each support portion 24 defines a rectangular cavity 241 in a top surface thereof proximate the mating face 21. A guiding opening 2411 is defined in each cavity 241 and is exposed to the mating face 21. A pair of positioning projections 2412 downwardly extend from the bottom surfaces (not labeled) of the support portions 24 for insertion in the corresponding guiding holes 131 of the first housing 1. A recess 2413 is defined in each cavity 241 proximate the mating section 23.

The shield 3 is stamped and formed from a conductive metal sheet with an inner contour substantially corresponding to an outer contour of an assembly of the first housing 1 and the second housing 2. The shield 3 comprises a mating cover 31 for enclosing the mating section 23 of the second housing 2 and a pair of parallel side walls 32 extending from opposite longitudinal edges of the mating cover 31. Two latching openings 33 are defined in each side wall 32 corresponding to the latching members 121 of the first housing 1. A V-shaped guiding cutout 331 communicates with each latching opening 33 for guiding the neck 1211 of the corresponding latching member 121 into the latching opening 33 to engage therewith. Each latching opening 33 has a circular periphery having a diameter substantially identical to the corresponding neck 1211 while each guiding cutout 331 has a configuration flaring from the latching opening 33. The cutout 331 has a width smaller than the diameter of the corresponding head 1212. Thus, the shield 3 can be easily and securely engaged with the first housing 1 by fitting the necks 1211 into the corresponding latching opening 33 through the corresponding guiding cutouts 331.

A pair of legs 34 downwardly extend from opposite ends of each side wall 32 for extending through the corresponding insertion slots 133 of the first housing 1. A pair of L-shaped clasps 35 extend from opposite ends of the shield 3 near the mating cover 31 for extending into the corresponding recesses 2413 of the second housing 2.

Each guiding member 4 is substantially cylindrical and has a diameter substantially identical to the guiding openings 2411 for properly engaging therewith. Each guiding member 4 forms a support plate 41 corresponding to the cavity 241 and a mating portion 42 having a pointed top.

Figure 2:
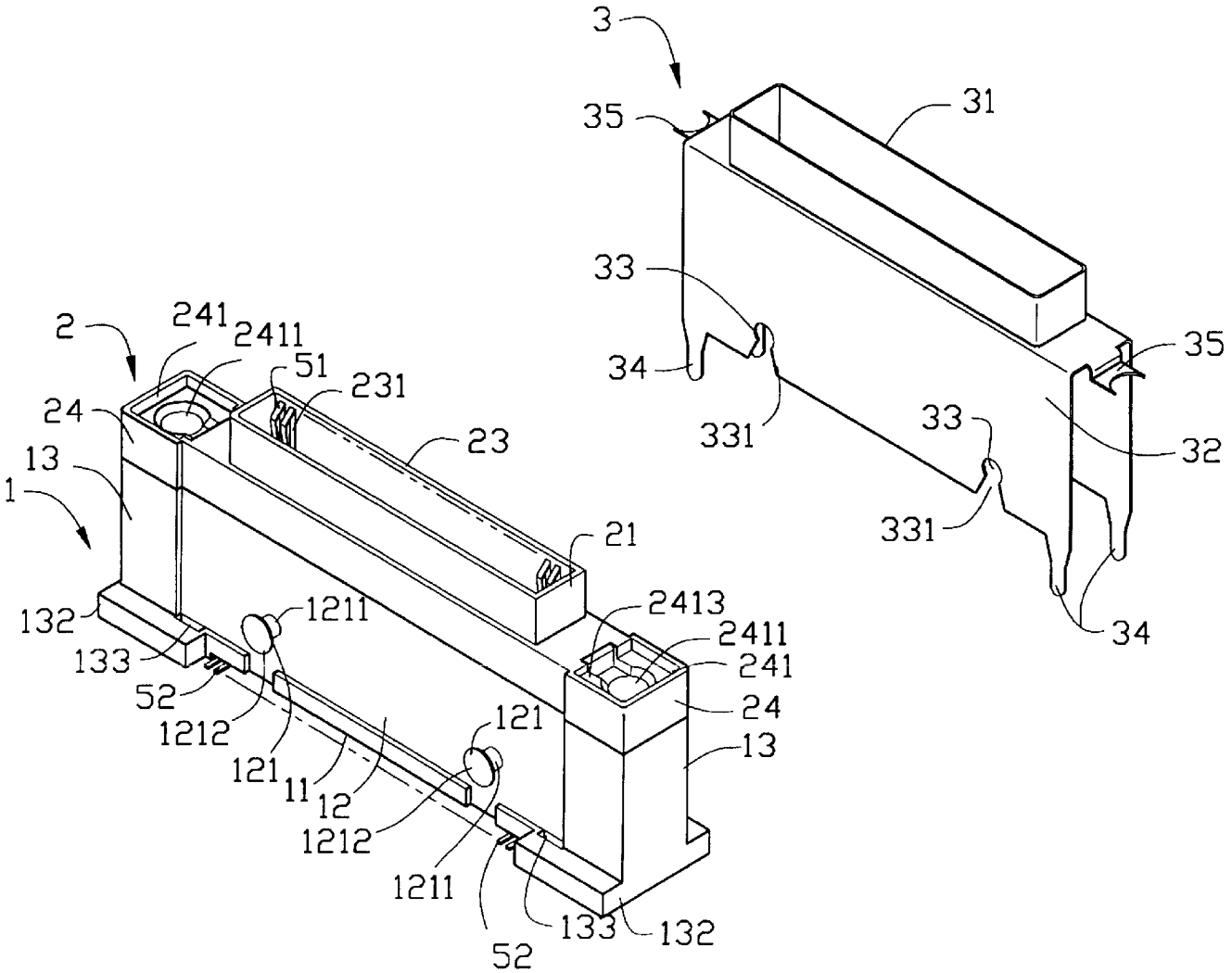
FIG. 2 is a partially exploded view of FIG. 1 omitting a pair of guiding members.
Figure 3:
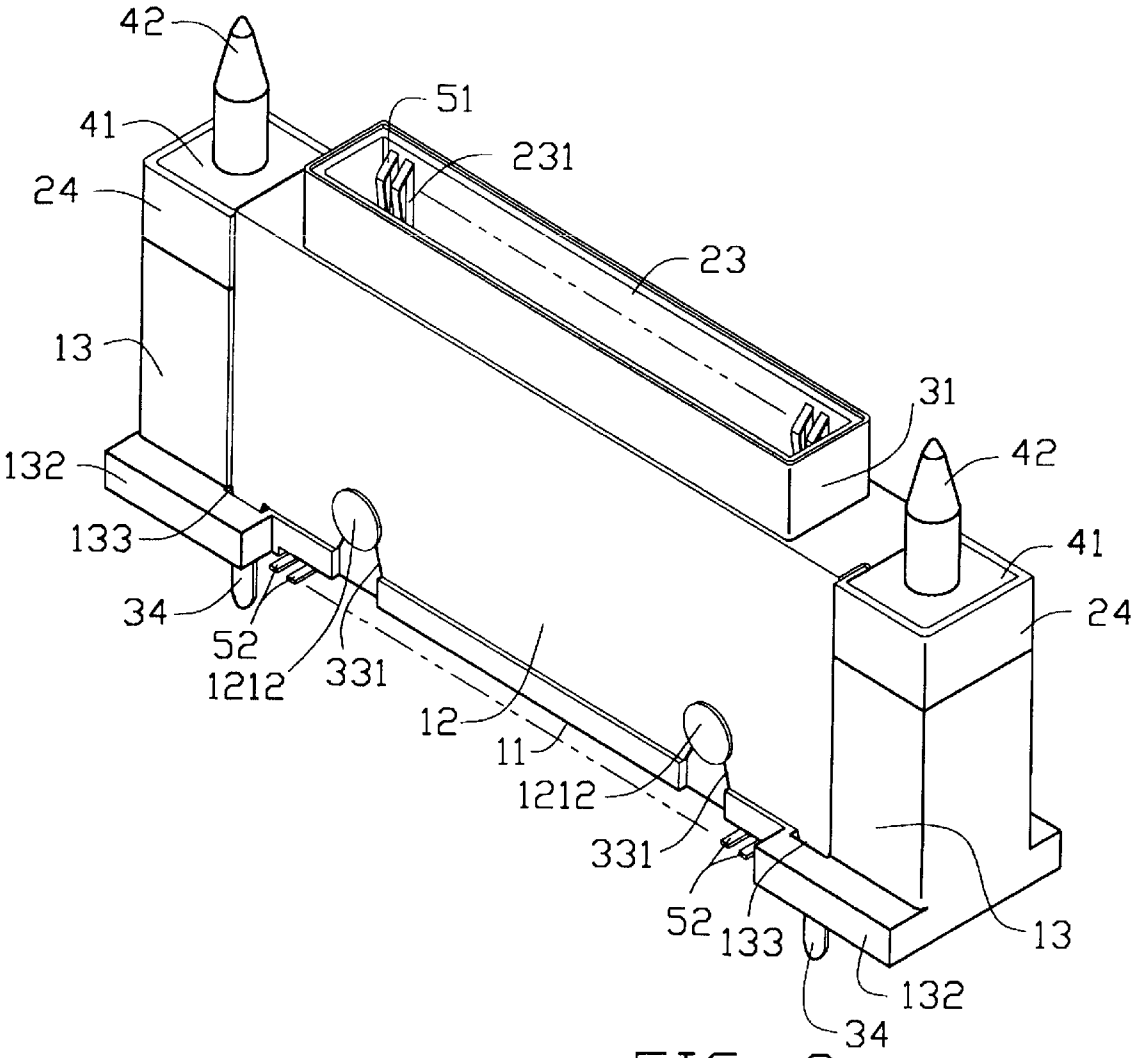
FIG. 3 is an assembled view of FIG. 1.

Referring to FIGS. 2 and 3, in assembly, the positioning projections 2412 of the second housing 2 are inserted into the corresponding guiding holes 131 of the first housing 1 whereby the joining face 20 abuts against the mating surface 10 and the contact ends 51 of the contacts 5 are received within the corresponding engaging slots 231 of the second housing 2.

The shield 3 is then assembled to the first and second housings 1, 2. The side walls 32 of the shield 3 abut against the corresponding side walls 12 of the first housing 1 and corresponding portions of the second housing 2, and the mating cover 31 encloses the mating section 23 of the second housing 2. The clasps 35 are received in the corresponding recesses 2413 of the second housing 2. The legs 34 extend through the corresponding insertion slots 133 of the first housing 1 for electrically connecting with a grounding circuit of the circuit board. When the shield 3 is fixed to the first and second housings 1, 2, the guiding cutouts 331 guide the neck 1211 of the latching members 121 to engage with the corresponding latching openings 33. Thus, the shield 3 is securely attached to the first housing 1 since the heads 1212 of the latching members 121 ensure that the shield 3 will not become disengaged from the first housing 1.

The guiding members 4 are fixed in the corresponding guiding openings 2411 of the second housing 2 whereby the support plates 41 are received in the corresponding cavities 241. The guiding members 4 electrically contact the corresponding clasps 35 of the shield 3 thereby forming a grounding path from the guiding members 4 to the circuit board via the clasps 35 and the legs 34. Thus, when the connector in accordance with the present invention engages with the mating connector, the guiding members 4 electrically contact a shell of the mating connector thereby discharging static electricity of the mating connector through the grounding path before the contacts 5 are electrically engaged with contacts of the mating connector (not shown). Therefore, the connector in accordance with the present invention exhibits excellent signal transmission qualities.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector, comprising:

a first dielectric housing comprising a mating surface, a joining surface and a pair of side walls, each side wall forming a plurality of latching members thereon, each latching member comprising a neck and a head outwardly extending from the neck and having a larger diameter than the neck;

a second dielectric housing comprising a mating face for mating with a mating connector, a joining face for engaging with the first dielectric housing, and a mating section upwardly projecting from the mating face;

a plurality of contacts received in the first dielectric housing, each contact comprising a mating end extending from the mating surface of the first dielectric housing into the mating section of the second dielectric housing for electrically connecting with the mating connector, and a joining end extending from the joining surface for being mounted to a circuit board; and a shield fixed to the first dielectric housing and the second dielectric housing, with a plurality of latching openings therein for securely engaging with the necks of the latching members of the first dielectric housing to prevent a movement of the shield relative to the first dielectric housing.

2. The electrical connector as claimed in claim 1, wherein each latching opening of the shield has a circular periphery defining a diameter substantially identical to the neck of the corresponding latching member for engaging therewith, and each neck has a length substantially identical to a thickness of the shield thereby preventing the shield from a sideward movement.

3. The electrical connector as claimed in claim 1, wherein a guiding cutout communicates with each latching opening, the guiding cutout guiding the neck of the latching member to engage with corresponding latching opening.

4. The electrical connector as claimed in claim 3, wherein each guiding cutout has an open end larger than the diameter of the neck but smaller than the diameter of the head of the corresponding latching member, thereby preventing the shield from moving in the mating direction.

5. The electrical connector as claimed in claim 1, wherein the first dielectric housing forms a pair of bases at opposite ends thereof, each base defining a guiding hole therein and forming a pair of extensions extending from opposite lower sides thereof and being flush with the joining surface of the first dielectric housing.

6. The electrical connector as claimed in claim 5, wherein a pair of insertion slots is defined between the extensions of each base and corresponding side wall, and a pair of legs integrally extend from opposite ends of the shield through corresponding insertion slots of the first dielectric housing for electrically connecting with a circuit board and forming a grounding path.

7. The electrical connector as claimed in claim 1, wherein: a pair of support portions is formed at opposite ends of the mating section of the second dielectric housing, each support portion defining a cavity therein, a recess in the cavity proximate the mating section, a guiding opening in the cavity, and a pair of positioning projections downwardly extending from a bottom face thereof for engaging within the first dielectric housing; and the shield comprises a mating cover for enclosing the mating section of the second dielectric housing and a pair of clasps integrally extending from opposite side walls of the mating cover for engaging with corresponding recesses of the second dielectric housing.

8. The electrical connector as claimed in claim 7, further comprising a pair of guiding members each having a support plate for engaging within corresponding cavities of the second dielectric housing and for contacting with corresponding clasps of the shield, and each having a mating portion outwardly extending from opposite sides of the support plate, the mating portion having an end for engaging within corresponding guiding openings of the second dielectric housing and an opposite end for electrically contacting with a shell of a mating connector.

9. An electrical connector, comprising:

a first dielectric housing comprising a mating surface, a joining surface and a pair of side walls, each side wall forming a plurality of latching members thereon;

a second dielectric housing comprising a mating face for mating with a mating connector, a joining face for engaging with the first dielectric housing, and a mating section upwardly projecting from the mating face;

a plurality of contacts received in the first dielectric housing, each contact comprising a mating end extending from the mating surface of the first dielectric housing into the mating section of the second dielectric housing for electrically connecting with the mating connector, and a joining end extending from the joining surface for being mounted to a circuit board; and a shield fixed to the first dielectric housing and said second dielectric housing, with a plurality of latching openings therein for securely engaging with the latching members of the first dielectric housing to prevent a movement of the shield relative to the first dielectric housing; wherein a pair of support portions is formed at opposite ends of the mating section of the second dielectric housing, each support portion defining a cavity therein, a recess in the cavity proximate the mating section, a guiding opening in the cavity, and a pair of positioning projections downwardly extending from a bottom face thereof for engaging within the first dielectric housing; and the shield comprises a mating cover for enclosing the mating section of the second dielectric housing and a pair of clasps integrally extending from opposite side walls of the mating cover for engaging with the corresponding recesses of the second dielectric housing.

* * * * *